US006298817B1

(12) United States Patent
Hoeg

(10) Patent No.: US 6,298,817 B1
(45) Date of Patent: Oct. 9, 2001

(54) EXHAUST VALVE FOR AN INTERNAL COMBUSTION ENGINE

(75) Inventor: Harro Andreas Hoeg, Allerçd (DK)

(73) Assignee: Man B&W Diesel A/S, Copenhagen SV (DK)

( * ) Notice: Subject to any disclaimer, the term of this patent is extended or adjusted under 35 U.S.C. 154(b) by 0 days.

(21) Appl. No.: 09/194,782

(22) PCT Filed: Jun. 3, 1997

(86) PCT No.: PCT/DK97/00246

§ 371 Date: Dec. 3, 1998

§ 102(e) Date: Dec. 3, 1998

(87) PCT Pub. No.: WO97/47862

PCT Pub. Date: Dec. 18, 1997

(30) Foreign Application Priority Data

Jun. 7, 1996 (DK) ..... 0642/96

(51) Int. Cl.[7] ..... F02L 3/02

(52) U.S. Cl. ..... 123/188.3; 123/188.2; 123/188.8

(58) Field of Search ..... 123/188.3, 188.8, 123/188.2, 188.11

(56) References Cited

U.S. PATENT DOCUMENTS

| | | | | |
|---|---|---|---|---|
| 1,557,025 | * | 10/1925 | Cochrane | 123/188.3 |
| 4,122,817 | * | 10/1978 | Matlock | 123/188.3 |
| 4,425,300 | | 1/1984 | Teramoto et al. | 420/453 |
| 4,530,322 | * | 7/1985 | Yamada et al. | 123/188.3 |
| 4,554,897 | * | 11/1985 | Yamada et al. | 123/188.3 |
| 4,734,968 | * | 4/1988 | Kuroishi et al. | 29/156.7 A |
| 5,431,136 | * | 7/1995 | Kenmoku et al. | 123/188.3 |
| 5,592,913 | * | 1/1997 | Matthews | 123/188.3 |

FOREIGN PATENT DOCUMENTS

| | | |
|---|---|---|
| 165 125 | 10/1992 | (DK) . |
| 0 384 013 | 8/1990 | (EP) . |
| 0 521 821 B1 | 1/1993 | (EP) . |
| 0 529 208 | 3/1993 | (EP) . |
| 0 602 904 A1 | 6/1994 | (EP) . |
| 422 388 | 3/1982 | (SE) . |
| 92/13179 | 8/1992 | (WO) . |

OTHER PUBLICATIONS

M. J. Donachie, Jr., "Superalloys Source Book", 1984, American Society for Metals, Table 9, pp. 29–32; table 5, p. 265; Fig. 2, p. 357.

"The Physical and Mechanical Properties of Valve Alloys and Their Use in Component Life Evaluation Analyses", London, 1990.

* cited by examiner

*Primary Examiner*—Tony M. Argenbright
*Assistant Examiner*—Katrina B. Harris
(74) *Attorney, Agent, or Firm*—Sughrue, Mion, Zinn, Macpeak & Seas, PLLC

(57) ABSTRACT

An exhaust valve for an internal combustion engine including a movable spindle with a valve disc which on its upper surface has an annular seat are of a material different from the base material of the valve disc. In the closed position of the valve the seat area abuts a corresponding seat area on a stationary valve member. The seat area on the upper surface of the valve disc is made of a material which has a yield strength of at least 1000 Mpa at a temperature of approximately 20° C.

33 Claims, 2 Drawing Sheets

EXHAUST VALVE FOR AN INTERNAL COMBUSTION ENGINE

CROSS-REFERENCE TO RELATED APPLICATIONS

The present application claims the benefit of priority from Danish patent application No. 642/96 filed on Jun. 7, 1996, and from international patent application No. PCT/DK97/00246 filed on Jun. 3, 1997.

BACKGROUND OF THE INVENTION

1. Field of the Invention

The present invention relates to an exhaust valve for an internal combustion engine, particularly a two-stroke cross-head engine, comprising a movable spindle with a valve disc which at its upper surface has a annular seat area of a material different from the base material of the valve disc, which seat area abuts a corresponding seat area on a stationary valve member in the closed position of the valve.

2. Description of Related Art

The development of exhaust valves for internal combustion engines has aimed for many years at extending the life and reliability of the valves. This has been done so far by manufacturing the valve spindles with a hot-corrosion-resistant material on the lower disc surface and a hard material in the seat area.

The seat area is particularly crucial for the reliability of the exhaust valve, as the valve has to close tightly to function correctly. It is well-known that the ability of the seat area to close tightly can be reduced by corrosion in a local area by a so-called burn through, where across the annular sealing surface a channel-shaped gutter emerges, through which hot gas flows when the valve is closed. Under unfortunate circumstances, this failure condition can arise and develop into a rejectable valve during less than 80 hours' operation, which means that often it is not possible to discover the beginning failure at the usual overhaul. Therefore, a burn through in the valve seat may cause unplanned shut-downs. If the engine is a propulsion engine in a ship, the condition may be initiated and develop into a failing valve during a single voyage between two ports, which may cause problems during the voyage and unintended expensive waiting time in port.

With a view to preventing burn throughs in the valve seat many different valve seat materials with ever increasing hardnesses have been developed over the years to make the seat wear-resistant by means of the hardness and reduce the formation of dent marks. The dent marks are a condition for development of a burn through as the dents may create a small leak through which hot gas flows. The hot gas can heat the material around the leak to a level of temperature where the gas with the aggressive components has a corrosive effect on the seat material so that the leak rapidly grows larger and the leakage flow of hot gas increases, which escalates the erosion. in addition to the hardness, seat materials have also developed towards a higher hot corrosion resistance to delay erosion after the occurrence of a small leak. The special requirements to the seat material and the deviant special requirements to material properties in other areas of the movable valve member necessitate a seat area of a material different from the base material of the valve disc, which also provides manufacturing advantages. A number of examples of known seat materials will be given below.

WO92/13179, for example, describes the use of the nickel-based alloy Alloy 50, the cobalt-based alloy Stellite 6 and a nickel-based alloy the most important alloy components of which are 20–24% Cr, 0.2–0.55% C and 4–7% Al. One object mentioned is that seat materials should be hard to reduce the formation of dent marks.

SE-B-422 388 describes a valve for an internal combustion engine having a base body made of a chromium-containing nickel alloy on which a chromium-containing cobalt alloy is deposited at a temperature exceeding 3000° C., whereupon the body is exposed to mechanical treatment and aging at a temperature higher than the operating temperature. An object of this is to improve the corrosion resistance of the seat material and impart a high hardness to it.

DK-B-165125 teaches an exhaust valve for an internal combustion engine with a seat area of a corrosion-resistant facing alloy comprising 13–17% Cr, 2–6% Al, 0.1–8% Mo, 1.5–3.5% B, 0.5–3% Ti, 4–7% Co and a balance of Ni. High hardness of the seat material is desired.

U.S. Pat. No. 4,425,300 teaches a welded-on hardfacing alloy comprising 10–25% Cr, 3–15% Mo, 3–7% Si, 1–1.2% C, 1–30% Fe and a balance of Ni. The alloy is without porosity and has a hardness comparable with that of cobalt-based alloys.

EP-A-0529208 teaches a nickel and chromium containing hardfacing alloy for welding-on in the valve seat area in a car engine. The alloy contains 30–48% Ni, 1.5–15% W and/or 1.0–6.5% Mo and the balance is of at least 40% Cr. W and Mo have a solution-strengthening effect on the alloy. C can be added in amounts from 0.3 to 2.0% to increase the hardness by carbide formation, and B can be added in amounts from 0.1 to 1.5% to increase the hardness by chromium boride formation. Nb can be added in amounts from 1.0 to 4.0% for formation of hardness-increasing intermetallic compounds as well as carbides and borides.

EP-A-0 521 821 teaches a valve made of NIMONIC 80A or NIMONIC 81, which is provided with a layer of INCONEL 625 or of INCONEL 671 in the seat area to impart to the seat a higher corrosion resistance than the NIMONIC base body. The publication mentions for the alloy INCONEL 671 that it only has to be welded on, while for the alloy INCONEL 625 it mentions that after the welding it contains a dendritic carbide structure and that the seat area therefore has to be hot-worked to homogenise the carbide distribution in the structure to improve corrosion resistance.

The book 'Diesel engine combustion chamber materials for heavy fuel operation' published in 1990 by The Institute of Marine Engineers, London, collects the experience gained for exhaust valve materials in a number of articles and provides recommendations as to how to design valves to achieve long life. Concerning valve seats the articles unanimously direct that the seat material has to have a high hardness and be of a material with a high resistance against hot corrosion. A number of different preferred materials for exhaust valves are described in Paper 7 of the book 'The physical and mechanical properties of valve alloys and their use in component evaluation analyses', including in its analysis of the mechanical properties of the materials a comparative table of the yield strength of the materials, seen to be below about 820 MPa.

SUMMARY OF THE INVENTION

It is desirable to prolong the life of the exhaust valve and particularly to reduce or avoid unpredictable and rapid development of burn throughs in the seat area of the valve. The Applicant has carried out tests with dent mark formation in seat materials and contrary to the established knowledge has established quite unexpectedly that the hardness of the seat material does not have any great influence on whether the dent marks emerge. The object of the present invention is to provide seat materials that anticipate the mechanism leading to formation of dent marks, whereby the basic condition for occurrence of burn throughs is weakened or eliminated.

In view of this the exhaust valve according to the invention is characterised in that the seat area at the upper surface of the valve disc is made of a material which has a yield strength of at least 1000 MPa at a temperature of approximately 20° C.

Dent marks are formed by particulate combustion residues, such as coke particles, which flow from the combustion chamber up through the valve and into the exhaust system while the exhaust valve is open. When the valve closes, the particles may get caught between the closing sealing surfaces on the valve seats.

From studies of numerous dent marks on valve spindles in operation it has been observed that new dent marks very rarely reach the upper closing rim, viz., the circumferential line at which the upper end of the stationary valve seat is brought into contact with the movable conical valve seat. In practice, the dents end about 0.5 mm away from the closing rim, which is without any immediate explanation, as a particle can also be expected to be caught in this area.

It has now been realised that the absence of dents immediately up to the closing rim is due to the fact that coke particles and other, even very hard particles are crushed to powder before the valve is completely closed. Part of the powder is blown away simultaneously with the crushing of the particles because the gas from the combustion chamber flows out through the gap between the closing sealing surfaces at approximately sonic velocity. The high gas velocity blows the powder near the closing rim away, and the absence of dents out to the rim shows that just about all particles getting caught between the sealing surfaces are pulverised. Even very thick particles are reduced in thickness by the crushing and blowing away of powder, and in practice the subsided piles of powder capable of forming the dent marks therefore have a highest thickness of 0.5 mm and a normal maximum thickness of 0.3–0.4 mm.

Especially within the most recent engine development where the maximum pressure may be 19S bar, the load on the lower surface of the disc may correspond to up to 400 tons. When the exhaust valve is closed and the pressure in the combustion chamber rises to the maximum pressure, the sealing surfaces are pressed completely together around an enclosed powder pile. This cannot be prevented, no matter how hard the seats are made.

When the combustion of the fuel commences and the pressure in the cylinder and thus the load on the valve disc increase, the enclosed powder pile starts wandering into the two sealing surfaces and at the same time the seat materials are elastically deformed. During this elastic deformation the surface pressure between the powder pile and the sealing surfaces rises, which usually makes the powder pile deform into a larger area. If the powder pile is sufficiently thick, the elastic deformation continues until the pressure in the contact area of the powder pile reaches the yield strength of the seat material of the lowest yield strength, whereupon this seat material is plastically deformed and formation of the dent mark commences. The plastic deformation may result in an increase of the yield strength owing to deformation hardening. If the two seat materials in the local area around the powder pile thus achieve uniform yield strengths, the powder pile starts plastically deforming the other seat material as well.

If the formation of dent marks is to be countered, this, as mentioned above, cannot be done by making seat materials harder, instead they have to be made resilient, which is obtained by manufacturing the seat areas with a high yield strength. The higher yield strength provides a double effect. Firstly, the seat material with the higher yield strength may be exposed to a higher elastic strain and thus absorb a thicker powder pile before plastic deformation occurs. The second essential effect is associated with the surface nature of the sealing surfaces in the areas facing the powder pile. The dent profile formed by the elastic deformation is even and smooth and promotes the distribution of the powder pile to a larger diameter, which partly reduces the thickness of the powder pile, partly reduces stresses in the contact area following from the greater contact area. At the transition from elastic deformation to plastic deformation a deeper and more irregular dent profile is rapidly created which will unsuitably anchor the powder pile and thus have a preventive effect on a further advantageous enlargement of the diameter of the pile.

Tests have shown that in an exhaust valve a powder pile of a thickness of about 0.14 mm can be absorbed between two seat areas of materials with a lower limit for the yield strength of 1000 MPa without any plastic deformation of the sealing surfaces. A large proportion of the particles caught between the seat surfaces will be crushed to a thickness of about 0.15 mm. The exhaust valve according to the invention prevents a noticeable proportion of the particles from forming dent marks because the seat surface merely springs back to its original shape when the valve opens, and at the same time the remains of the crushed particle are blown away from the seat surfaces.

In consideration of an increase of the elastic properties of the seat area, it is preferred that the seat area material has a yield strength of at least 1100 MPa, preferably at least 1200 MPa. Young's modulus for the current seat material is substantially unchanged at increasing yield strengths, which gives an approximately linear correlation between yield strength and the highest elastic strain. It appears from the above comments that a seat material with a yield strength of 2500 MPa or more would be ideal because it could absorb the powder piles of the normally most frequently occurring pile thicknesses purely by elastic deformation. However, at present suitable materials with such a high yield strength are not at hand. It will appear from the below description that some of the seat materials available today can be manufactured in a manner that raises the yield strength to at least 1100 MPa. All other things being equal, this 10% increase in yield strength will result in at least a 10% reduction of the depth of any dent marks. For most types of particles, the suitable limit of 1200 MPa is sufficiently high to provide a noticeable reduction of the pile thickness and consequently may result in a reduction of the dent mark depths of up to 30%, but at the same time the number of possible materials is narrowed down. This also applies to seat materials with a yield strength of at least 1300 MPa.

In an especially preferred embodiment the seat area material has a yield strength of at least 1400 MPa. This yield strength is almost double the yield strength of the seat materials used at present, and based on the present understanding of the mechanism of dent mark formation the material with this high yield strength is presumed to largely eliminate problems with seat area burn throughs. The depth of the few dent marks that can be formed in this seat material will be too small for leakage gas to flow through the dent mark in sufficiently large quantities for the seat material to be heated to a temperature where hot corrosion becomes effective.

In one embodiment the seat areas on the stationary member and the valve disc, respectively, have substantially the same yield strength at the operating temperatures of the seat areas. The largely uniform yield strengths of the two seat materials result in approximately the same manner of deformation of both sealing surfaces when the powder pile is pressed into the surfaces, which reduces the resulting plastic deformation in each of the surfaces. The stationary seat area is colder than the seat area on the spindle, which means that the spindle seat material should have the higher yield strength at about 20° C. in view of the fact that the yield strength for many materials drops at increasing temperatures. This embodiment is especially advantageous if the stationary seat area is made of a hot-corrosion-resistant material.

If the stationary seat area is of hardened steel or cast iron, the seat area on the stationary member preferably has a substantially higher yield strength than the seat area on the valve disc at the operating temperatures of the seat areas. With this design any dent marks will be formed on the valve spindle. This provides two advantages. Firstly the seat area on the spindle is normally made of a hot-corrosion-resistant material so that any dent mark will find it more difficult to develop into a burn through than if the dent was located on the stationary member. Secondly the spindle rotates so that at each valve closure the dent will be located at a new position on the stationary sealing surface, the heat influence thus being distributed on the stationary seat area.

The following will describe different materials usable according to the invention as valve seat materials. It should be noted that NIMONIC and INCONEL are proprietary trademarks of INCO Alloys, and that Udimet is a proprietary trademark of Special Metals Inc.

The seat area material may be a nickel-based chromium-containing alloy comprising in terms of per cent by weight at least 10% of solution-strengthening components, such as Mo, W, Co, Hf, Fe and/or Cr, where the alloy is welded on to the valve disc and then the yield strength of the alloy has been increased to a value higher than the above lower limit by cold-working of the material at a temperature lower than or around the recrystallisation temperature of the alloy. The following can be mentioned as examples of alloys of this type: IN 625 has a yield strength after welding of approximately 450 MPa, but after at least 27% cold-working the yield strength is approximately 1000 MPa, and after 40% cold-working about approximately 1100 MPa. IN 671 has a yield strength of approximately 490 MPa in a welded condition, and cold-working of between 30 and 40% may bring the yield strength above 1000 MPa. After the welding, IN 690 has a yield strength of approximately 500 MPa, and after cold-working of approximately 45% the yield strength of this alloy has been increased to approximately 1035 MPa. IN 718-like alloys also have a yield strength of approximately 500 MPa after the welding, and after cold-working of at least 35% the yield strength has been brought to just over 1000 MPa. However, not all IN 718-like alloys exhibit a strong increase of the yield strength at cold-working or heat treatment, which will be described in further detail below.

For the alloys containing Nb and/or Ta a further increase of the yield strength of the alloy can be achieved after cold-working by means of a precipitation-hardening heat treatment. This also applies to the alloys containing Al and Ti, but they normally require a fine adjustment of these two components and further suffer from the minor disadvantage that after welding it may be necessary to carry out solution annealing with subsequent heat treatment to enable the cold-working, Al and Ti having a precipitation-hardening effect already at welding.

Alternatively the seat area material may be a nickel-based chromium-containing alloy containing Nb and/or Ta, the alloy being welded on to the valve disc whereupon its yield strength has been increased to a value higher than said lower limit by means of a precipitation-hardening heat treatment. An example of such an alloy capable of achieving a high yield strength without cold-working is Rene 220. After welding, this alloy has a low yield strength, but at a suitable heat treatment the yield strength can easily in terms of manufacturing be brought substantially above 1000 MPa. NIMONIC Alloy PK31 and IN 718-like alloys can be given yield strengths of substantially above 1000 MPa by heat treatment without cold-working.

A further alternative that involves no cold-working either, is that the seat area material is a nickel-based chromium-containing alloy containing in terms of percent by weight at least 10% of solution-strengthening components, such as Mo, W, Co, Hf, Fe and/or Cr, and precipitation-hardening components, such as Nb, Ta, Al and/or Ti, and that the alloy is welded on to the valve disc and then its yield strength is increased to a value higher than said lower limit by means of a precipitation-hardening heat treatment. As these alloys contain solution-strengthening components they have a tendency towards increasing the yield strength if in practice they are exposed to plastic deformation by a powder pile.

In another embodiment the seat area material is a nickel-based chromium-containing alloy including at least one component selected from among Co, Mo, Hf, Fe, W, Ti, Nb, Ta, Al, and at least the seat area is manufactured by means of a HIP process, possibly with a subsequent heat treatment to provide controlled precipitation hardening, typically solution annealing followed by quenching and precipitation hardening. Among especially applicable alloys can be mentioned IN 100, which has a yield strength of approximately 1300 MPa at approximately 20° C. after the HIP process and is further especially advantageous in that the yield strength is maintained at a very high level at the operating temperature of the spindle, the yield strength being approximately 1285 MPa at 650° C. After the HIP process, Merl 76 has a yield strength of approximately 1200 MPa, and Udimet 700 has a correspondingly high yield strength. Rene 95 is also suitable and after the HIP process has a yield strength of approximately 1230 MPa dropping to approximately 1160 MPa at 500° C. The alloy NIMONIC Alloy 105 can also be used, possibly with a minor modification of the components forming carbonitride compounds and oxide compounds which, after the HIP process, can form coherent chains of brittle compounds, so-called PPBs (Prior Particle Boundaries). To the extent that these alloys contain solution-strengthening components the yield strength can be further increased by cold-working. The HIP process can also be supplemented with forging and extrusion processes. As an alternative to the HIP process, other powder metallurgical compacting processes can also be used with the above seat materials.

In yet another embodiment the seat area material is a nickel-based chromium-containing alloy including at least one component selected from among Co, Mo, W, Hf, Fe, Ti, Nb, Ta, Al, the seat area being manufactured by means of either casting or powder metallurgical application followed by thermo-mechanical forging, rolling or beating at a temperature lower than or around the recrystallisation temperature of the alloy and with a degree of deformation of the seat area increasing the yield strength of its material to a value higher than said lower limit. The powder metallurgical application may, for example, be thermal spraying-on of particulate or powdery starting material on a spindle base body, and the thermo-mechanical forging may comprise cold-working of the sprayed-on material. Preferably the cold-working takes place at a suitably raised temperature so as to avoid precipitation hardening in an extent that may bother the deformation process. The seat area may, for example, be made of an IN 718-like alloy that may have been exposed to a degree of deformation of at least 35%. The seat area may also be made of INCONEL Alloy X-750 which has been hot-worked and precipitation-hardened to a yield strength of approximately 1110 MPa. If the alloy contains precipitation-hardening components of the above type, it is further possible to increase the yield strength further through a precipitation-hardening heat treatment.

Especially advantageous alloys for the seat area material comprise 10–25% Cr, at the most 25% Co, at the most 10% Mo+W, at the most 11% Nb, at the most 20% Ta, at the most 3% Ti, at the most 0.55% Al, at the most 0.3% C, at the most 1% Si, at the most 0.015% P, at the most 0.015% S, at the most 3% Mn, at the most 25% Fe and a balance of Ni, and preferably the components Al, Ti and Ni are limited to up to 0.5% Al, 0.7–3% Ti and 52–57% Ni, the content of Nb+Ta/2 suitably being at least 3%.

The choice of alloy and the consequent manufacturing process may be influenced by the size of the exhaust valve, as a cold-working of many percent may require strong tools when the valve disc is large, for example with the external diameter being in the interval from 130 mm to 500 mm.

The present invention also relates to the use of a nickel-based chromium-containing alloy with a yield strength of at least 1000 MPa at approximately 20° C. as a dent mark limiting or preventive material in an annular seat area at the upper surface of a movable valve disc in an exhaust valve for an internal combustion engine, particularly a two-stroke crosshead engine, the seat area being made of an alloy different from the base material of the valve disc, and abutting a corresponding seat area on a stationary valve member when the valve is closed. The special advantages of using such a dent mark limiting material appear from the above description.

BRIEF DESCRIPTION OF THE DRAWINGS

Examples of embodiments of the invention will now be described below in further detail with reference to the highly schematic drawing, in which FIG. 2 is a segmental view of the two seat areas with a typical dent mark sketched in.

DETAILED DESCRIPTION OF THE INVENTION

Figure 1:
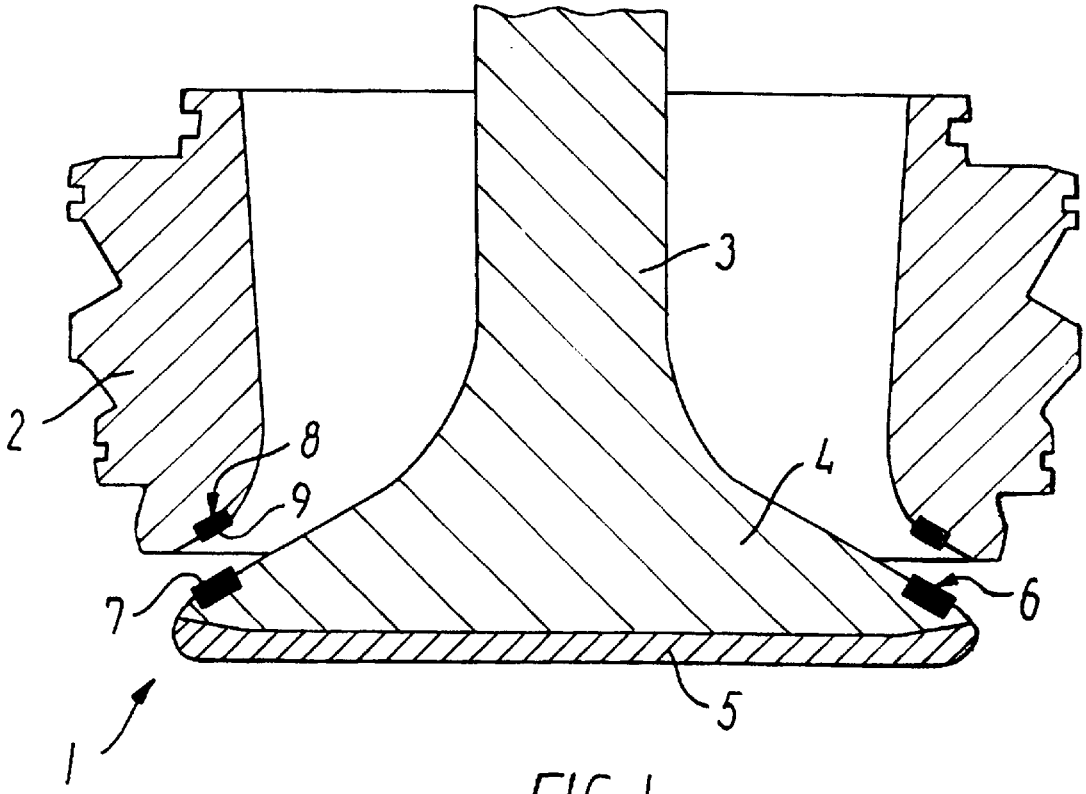
FIG. 1 is a longitudinal sectional view through an exhaust valve according to the invention.

FIG. 1 shows an exhaust valve generally designated 1 for a large two-stroke internal combustion engine, which may have cylinder diameters ranging from 250 to 1000 mm. The stationary valve member 2 of the exhaust valve, also called the bottom piece, is mounted in a cylinder cover, not shown. The exhaust valve has a movable spindle 3 supporting at its lower end a valve disc 4 and, in a well-known manner, being connected at its upper end with a hydraulic actuator for opening of the valve and a pneumatic return spring returning the spindle to its closed position. FIG. 1 shows the valve in a partially open position.

The lower surface of the valve disc is provided with a layer of hot-corrosion-resistant material 5. An annular seat area 6 on the upper surface of the valve disc is at a distance from the outer rim of the disc and has a conical sealing surface 7. The valve disc for the large two-stroke crosshead engine can have an external diameter in the interval from 120 to 500 mm depending on the cylinder bore.

The stationary valve member is also provided with a slightly projecting seat area 8 forming an annular conical sealing surface 9 which abuts the sealing surface 7 in the closed position of the valve. As the valve disc changes shape during heating to the operating temperature, the seat area is designed so that the two sealing surfaces are parallel at the operating temperature of the valve, which means that on a cold valve disc the sealing surface 7 only abuts the sealing surface 9 at the latter's upper rim 10 located farthest away from the combustion chamber.

Figure 2:
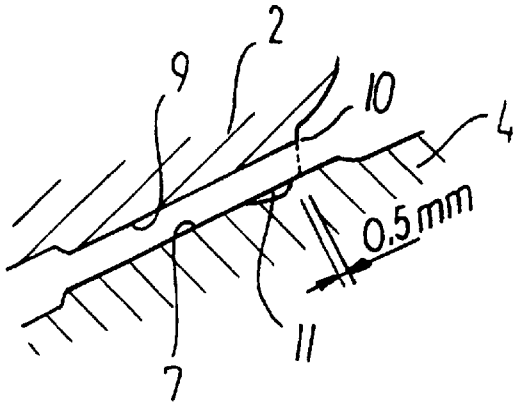

FIG. 2 shows a typical dent mark 11 ending approximately 0.5 mm away from the closing rim on the sealing surface 7, viz., the circular arc where the upper rim 10 hits the sealing surface 7 as indicated by the vertical dotted line.

Figure 3:
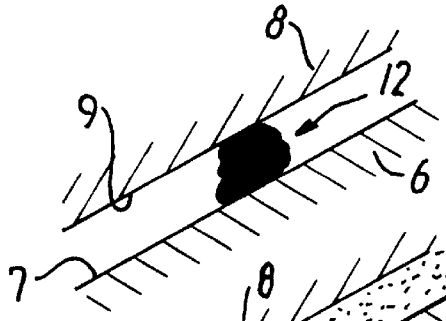
FIGS. 3–6 are segmental views of the two seat areas illustrating the particle crushing and the introductory steps in the dent mark formation.
Figure 4:
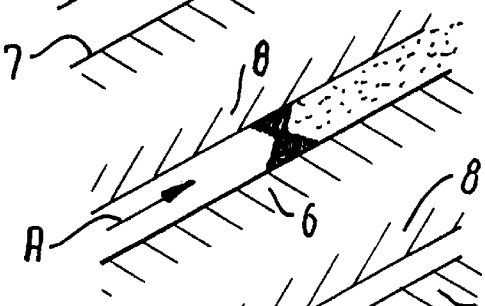

FIG. 3 shows a hard particle 12 which is caught between the two sealing surfaces 7, 9 immediately before the valve closes completely. At the continued closing motion, the particle is crushed into powder, of which a considerable part is entrained by the gas flowing up between the seats at sonic velocity as shown by the arrow A in FIG. 4. Part of the powder from the crushed particle will be locked between the sealing surfaces 7, 9 because the particles nearest the surfaces are retained by frictional forces, and the particles in the interspace are locked by shear forces in the powder. Thus, opposite conical powder piles are formed facing tip to tip. The assumption prevailing so far to the effect that a solid particle is caught between the seat surfaces is thus not correct. Instead a reduction of the amount of material caught between the seats occurs because part of the powder blows away.

Figure 5:
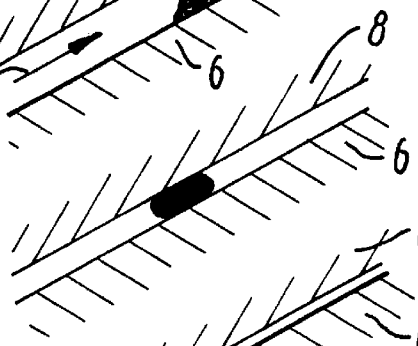

At the continued closing motion, the conical powder accumulations collapse and are spread in the plane of the surfaces to a lens-shaped powder body or a powder pile, as shown in FIG. 5. This lens-shaped powder body has proved to have a maximum thickness of 0.5 mm and a normal thickness for the largest accumulations of between 0.3 and 0.4 mm.

Figure 6:
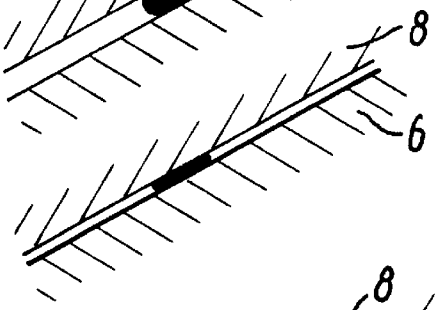

FIG. 6 shows the situation when the valve is closed, but before the pressure in the combustion chamber rises as a consequence of the combustion of the fuel. The pneumatic return spring is not in itself strong enough to pull the sealing surface 7 completely tight against the sealing surface 9 in the area around the powder body.

Figure 7:
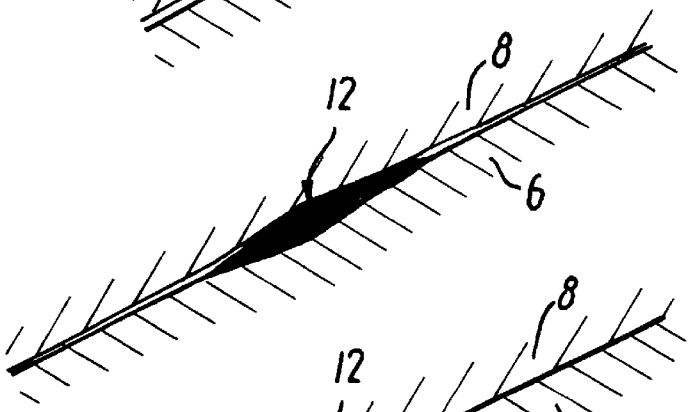
FIGS. 7 and 8 are enlarged segmental views of the dent mark formation.
Figure 8:
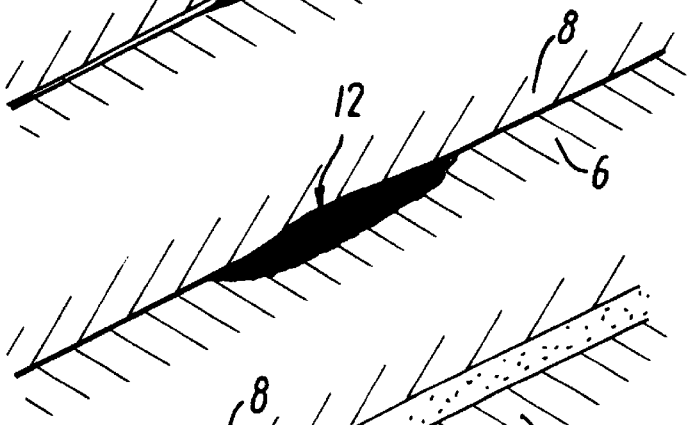

When the pressure in the combustion chamber rises after ignition of the fuel, the upward force on the lower disc surface rises strongly, and the sealing surfaces are pressed closer against each other, and at the same time the powder body starts deforming the sealing surfaces elastically. If the powder body is sufficiently thick and the yield strength of the material is not sufficiently high, the elastic deformation will turn into plastic deformation making the dent permanent. FIG. 7 shows a situation where the stationary seat area 8 has the highest yield strength, and where the seat area 6 on the disc is deformed elastically to just below its yield limit. At the continued compression to the completely compressed position of the sealing surfaces shown in FIG. 8, the powder body sinks into the sealing surface, the seat material being plastically deformed.

Figure 9:
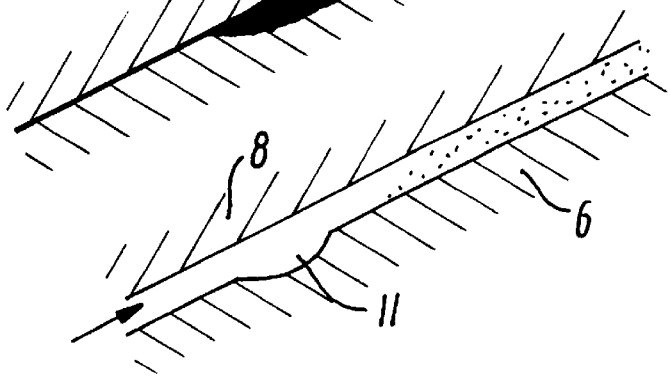
FIG. 9 is a corresponding view of the surfaces immediately after reopening of the valve.

When the valve reopens, the particles are blown away by the outflowing gas as shown in FIG. 9, and at the same time the seat materials spring back to their unloaded condition. To the extent a plastic deformation has occurred of one or both seat surfaces, a permanent dent mark 11 will be present in the sealing surface with a smaller depth than the largest indentation made by the powder body. The higher the yield strength of the seat material, the smaller the dent mark.

Now examples of analyses for suitable seat materials will be described. All amounts are stated in percent by weight, and inevitable impurities are disregarded. It should also be mentioned that indications of yield strengths in the present description mean yield strengths at a temperature of approximately 20° C., unless another temperature is indicated. The alloys are chromium-containing nickel base alloys (or nickel-containing chromium base alloys), and they have the property that there is no proper correlation between the hardness of the alloy and its yield strength, but on the contrary probably a correlation between hardness and tensile strength. In connection with these alloys, the yield strength means the strength generated by a strain of 0.2 ($R_{p0.2}$).

The alloy IN 625 comprises 20–23% Cr, 8–10% Mo, 3.15–4.15% Ta+Nb, up to 5% Fe, up to 0.1% C, up to 0.5% Mn, up to 0.5% Si, up to 0.4% Al, up to 0.4% Ti, up to 1.0% Co, up to 0.015% S, up to 0.015% P and a balance of at least 58% Ni. The yield strength of the alloy can be increased by means of plastic deformation and to some extent also by precipitation hardening.

The alloy IN 671 comprises 0.04–0.08% C, 46–49% Cr, 0.3–0.5% Ti and a balance of Ni. The yield strength of the alloy can be increased by means of plastic deformation and by precipitation hardening.

The alloy IN 690 comprises 27–30% Cr, 7–11% Fe, up to 0.05% C, optionally small amounts of Mg, Co, Si and a balance of at least 58% Ni. The yield strength of the alloy can be increased by means of plastic deformation.

The IN 718-like alloy comprises 10–25% Cr, up to 5% Co, up to 10% Mo+W, 3–12% Nb+Ta, up to 3% Ti, up to 2% Al, up to 0.3% C, up to 1% Si, up to 0.015% P, up to 0.015% S, up to 3% Mn, 5–25% Fe and a balance of Ni. The alloy is special in that the possibilities of increasing the yield strength depend very much on the amounts of the individual components, particularly Al, Ti, Ni and Nb, the Al content being of particular influence. If the content of Al is higher than 0.55%, the yield strength is negatively affected. The Al content should be kept below 0.5%. If it is desired to increase the yield strength by means of precipitation hardening, the content of Nb+Ta should be higher than 4%, preferably higher than 7%, and the content of Ti should be higher than 0.7%, preferably in the interval from 0.95% to 2%. At the same time, the content of Ni can advantageously be in the interval between 47% and 60%, preferably between 52% and 57%. If it is desired to increase the yield strength by plastic deformation, the content of Co and Mo+W should be chosen in the upper half of the above intervals. If the components are chosen within the above preferred intervals, and the alloy is both deformed plastically by, for example, more than 50% and is precipitation-hardened, the yield strength can be brought to more than 1600 MPa.

The alloy NIMONIC Alloy 105 has a nominal analysis of 15% Cr, 20% Co, 5% Mo, 4.7% Al, up to 1% Fe, 1.2% Ti and a balance of Ni.

The alloy Rene 220 comprises 10–25% Cr, 5–25% Co, up to 10% Mo+W, up to 11% Nb, up to 4% Ti, up to 3% Al, up to 0.3% C, 2–23% Ta, up to 1% Si, up to 0.015% S, up to 5% Fe, up to 3% Mn and a balance of Ni. Nominally, Rene 220 contains 0.02% C, 18% Cr, 3% Mo, 5% Nb, 1% Ti, 0.5% Al, 3% Ta and a balance of nickel. Deformation combined with precipitation hardening can achieve an extremely high yield strength in this material. At a degree of deformation of 50% at 955° C., the yield strength becomes approximately 1320 MPa; at a degree of deformation of 50% at 970° C., the yield strength becomes approximately 1400 MPa; at a degree of deformation of 50% at 990° C., the yield strength becomes approximately 1465 MPa, and at a degree of deformation of 25% at 970° C., the yield strength becomes approximately 1430 MPa. Precipitation hardening has been applied for 8 hours at 760° C. followed by 24 hours at 730° C. and 24 hours at 690° C.

The alloy NIMONIC PK31 nominally comprises 0.04% C, 20% Cr, 2.3% Ti, 0.45% Al, 14% Co, 4.5% Mo, 5% Nb, up to 1% Fe and possibly small amounts of Si, Cu and M, and a balance of Ni.

The alloy Merl 76 has the nominal analysis of 0.015% C, 11.9% Cr, 18% Co, 2.8% Mo, 1.2% Nb, 0.3% Hf, 4.9% Ti, 4.2% Al, 0.016% B, 0.04% Zr and a balance of Ni.

The alloy Udimet 700 has the nominal analysis of 0.15% C, 15% Cr, 18.5% Co, 5.3% Mo, 4.2% Ti, 3.5% Al, up to 1% Fe and a balance of Ni.

The alloy Rene 95 comprises up to 0.08% C, 11.8–14.6% Cr, 7.5–8.5% Co, 3.1–3.9% Mo, 3.1–3.9% W, 3.1–3.9% Nb, 3.1–3.9% Ti, 2.1–3.1% Al, up to 0.02% B, up to 0.075% Zr and a balance of Ni.

Concerning the nominal analyses stated above it is obvious that in practice, depending on the alloy actually produced, deviations may naturally occur from the nominal analysis, just as inevitable impurities may also occur for all analyses.

Technical literature describes in detail how to heat treat the various alloys to generate precipitation hardening, and the heat treatment for solution annealing and the recrystallisation temperatures of the alloys are also well-known. Therefore, only a few examples will be described below.

Rene 220:

Four layers of a welding powder of the following analysis: 0.03% C, 20.2% Cr, 2.95% Mo, 11.7% Co, 1.2% Ti, 5.05% Nb, 3.1% Ta, and a balance of Ni, were welded by means of PTAW on to a base body of austenitic stainless steel AISI 316. The body with the alloy according to the invention thus deposited was subsequently heat treated for 4 hours at 775° C. and for 4 hours at 700° C. From the base body, two usual tensile test blanks were made, and the tensile test showed a yield strength of 1138 MPa and 1163 MPa, respectively. Then a base body manufactured in the same manner was heat treated for 4 hours at 750° C. followed by 8 hours at 700° C. At the tensile test, the yield strengths of two blanks were measured at 1074 MPa and 1105 MPa, respectively. Then a base body manufactured in the same manner was heat treated for 8 hours at 750° C. followed by 4 hours at 700° C. At the tensile test the yield strengths of two blanks were measured at 1206 MPa and 1167 MPa, respectively. Finally, a base body manufactured in the same manner was heat treated for 4 hours at 800° C. followed by 8 hours at 700° C. At the tensile test the yield strengths of two blanks were measured at 1091 MPa and 1112 MPa, respectively.

In the cases where it is desired to increase the yield strength by means of cold-working of the material, this may be carried out in a well-known manner by, for example, rolling or forging of the seat area or in another manner, such as beating or hammering thereof, whereupon the sealing surface of the seat is ground in. If the alloy contains precipitation-hardening components, the cold-working can suitably be effected at a suitably raised temperature as mentioned above.

Below, an example will be given of the manufacture of an exhaust valve where the seat area is formed by means of a HIP process. A base body of a suitable material, such as steel, alloyed steel or a nickel alloy, is manufactured in the usual manner to the desired shape without the seat area. Then the desired seat material is applied on the base body by a well-known HIP process (HIP is an abbreviation of Hot Isostatic Pressure). This process uses particulate starting material, for example manufactured by atomization of a liquid jet of a molten nickel and chromium containing alloy into a chamber with an inactive atmosphere, whereby the drop-shaped material is quenched and solidifies as particles with a very dense dendritic structure.

The particulate starting material is arranged on top of the base body on the upper surface of the valve disc in an amount adjusted to the desired thickness of the seat area. Then the body is arranged in a mould and placed in a HIP chamber which is closed, and a vacuum is applied to extract undesired gases. Then the HIP process is started, in which the particulate material is heated to a temperature ranging between 950 and 1200° C., and a high pressure of, for example, 900–1200 bar is applied. At these conditions the starting powder becomes plastic and is unified to a coherent dense material substantially without melting. Then the body is removed, and if desired it can then be exposed to solution annealing, for example, for Rene 95 for 1 hour at a temperature of 1150° C. followed by quenching either in a salt bath to an intermediate temperature (typically 535° C.) followed by air cooling to room temperature, or by quenching in gases to room temperature. Then hot/cold-working can be carried out after these steps, and if the composition of the alloy renders it possible, precipitation hardening may also be performed, for example, for Rene 95 for 1 hour at 870° C. followed by 24 hours at 650° C., whereupon the body is brought to room temperature by air cooling. Finally the body can be ground in to the desired dimensions.

As base body it is possible to use a valve disc without a shaft, the shaft then being mounted on the valve disc after conclusion of the HIP process. This mounting may, for example, take place by means of friction welding. The advantage of so doing is that the HIP chamber is better exploited because the chamber may hold several base bodies at the same time when the shaft is post-mounted. It is also possible to manufacture the whole valve disc or, if desired, the whole valve spindle from particulate material by means of the HIP process using different particle compositions in different areas of the body, adapted to the desired properties of the materials in the areas in question and based on considerations of economy.

Cold-working in the present context means either regular cold-working at a temperature substantially below the recrystallisation temperature of the alloy or a thermo-mechanical deformation at a temperature below or just around the lower temperature area for the recrystallisation. In the latter case it is advantageous to cool the body to the working temperature from a solution annealing without first having cooled it down to room temperature.

What is claimed is:

1. An exhaust valve for an internal combustion engine having a stationary valve member with a seat area, wherein the exhaust valve comprises a movable spindle with a valve disc of a base alloy, said valve disk having an upper surface with an annular seat area of a seat alloy different from said base alloy, which seat area abuts the seat area on the stationary valve member in the closed position of the valve, said seat alloy having a yield strength ($R_{p0.2}$) of at least 1000 MPa at a temperature of approximately 20° C., wherein said seat alloy is a nickel-based chromium-containing alloy comprising in terms of percent by weight at least 10% of solution-strengthening components, such as Mo, W, Co, Hf, Fe and/or Cr, and wherein the alloy is welded on to the valve disc and then the yield strength of the alloy has been increased to above said 1000 MPa by cold-working of the alloy at a temperature lower than or around the recrystallisation temperature of the alloy.

2. An exhaust valve according to claim 1, wherein the alloy contains Nb and/or Ta, and wherein, after the cold-working, the yield strength of the alloy has been further increased by means of a precipitation-hardening heat treatment.

3. An exhaust valve according to claim 2, wherein the alloy contains Al and/or Ti.

4. An exhaust valve according to claim 1, wherein the alloy contains Al and Ti, and wherein, after welding but before cold-working, the alloy has been solution annealed and then quenched.

5. An exhaust valve according to claim 4, wherein the seat alloy comprises 10–25% Cr, at the most 25% Co, at the most 10% Mo+W, at the most 11% Nb, at the most 20% Ta, at the most 3% Ti, at the most 0.55% Al, at the most 0.3% C, at the most 1% Si, at the most 0.015% P, at the most 0.015% S, at the most 3% Mn, at the most 25% Fe, and a balance of Ni.

6. An exhaust valve according to claim 5, wherein the components Al, Ti and Ni are limited to at the most 0.5% Al, 0.7–3% Ti and 52–57% Ni, the content of Nb+Ta/2 optionally being at least 3%.

7. An exhaust valve for an internal combustion engine having a stationary valve member with a seat area, wherein the exhaust valve comprises a movable spindle with a valve disc of a base alloy, said valve disk having an upper surface with an annular seat area of a seat alloy different from said base alloy, which seat area abuts the seat area on the stationary valve member in the closed position of the valve, said seat alloy having a yield strength ($R_{p0.2}$) of at least 1000 MPa at a temperature of approximately 20° C., wherein the seat alloy is a nickel-based chromium-containing alloy containing Nb and/or Ta, said alloy having been welded on to the valve disc, and wherein after the welding the yield strength of the alloy has been increased by means of a precipitation-hardening heat treatment.

8. An exhaust valve according to claim 7, wherein the seat alloy is a nickel-based chromium-containing alloy containing in terms of percent by weight at least 10% of solution-strengthening components, such as Mo, W, Co, Hf, Fe and/or Cr, and precipitation-hardening components, such as Nb, Ta, Al and/or Ti, and wherein said alloy has been welded on to the valve disc and then its yield strength has been increased by means of a precipitation-hardening heat treatment.

9. An exhaust valve according to claim 8, wherein the seat alloy comprises 10–25% Cr, at the most 25% Co, at the most 10% Mo+W, at the most 11% Nb, at the most 20% Ta, at the most 3% Ti, at the most 0.55% Al, at the most 0.3% C, at the most 1% Si, at the most 0.015% P, at the most 0.015% S, at the most 3% Mn, at the most 25% Fe, and a balance of Ni.

10. An exhaust valve according to claim 9, wherein the components Al, Ti and Ni are limited to at the most 0.5% Al, 0.7–3% Ti and 52–57% Ni, the content of Nb+Ta/2 optionally being at least 3%.

11. An exhaust valve according to claim 7, wherein the seat alloy has a yield strength of at least 1100 MPa.

12. An exhaust valve according to claim 7, wherein the seat alloy has a yield strength of at least 1200 MPa.

13. An exhaust valve according to claim 7, wherein the seat alloy has a yield strength of at least 1300 MPa.

14. An exhaust valve according to claim 7, wherein the seat alloy has a yield strength of at least 1400 MPa.

15. An exhaust valve according to claim 7, wherein the seat areas on the stationary member and the valve disc, respectively, have mainly the same yield strength at operating temperatures of the seat areas.

16. An exhaust valve according to claim 7, wherein the seat area on the valve disc has a substantially lower yield strength than the seat area on the stationary member at operating temperatures of the seat areas.

17. An exhaust valve for an internal combustion engine having a stationary valve member with a seat area, wherein the exhaust valve comprises a movable spindle with a valve disc of a base alloy, said valve disk having an upper surface with an annular seat area of a seat alloy different from said base alloy, which seat area abuts the seat area on the stationary valve member in the closed position of the valve, said seat alloy having a yield strength ($R_{p0.2}$) of at least 1000 MPa at a temperature of approximately 20° C., wherein the seat alloy is a nickel-based chromium-containing alloy including at least one component selected from among Co, Mo, Hf, Fe, W, Ti, Nb, Ta, Al, and wherein at least the seat area is manufactured by means of a HIP process.

18. An exhaust valve according to claim 17, wherein the seat alloy comprises 10–25% Cr, at the most 25% Co, at the most 10% Mo+W, at the most 11% Nb, at the most 20% Ta, at the most 3% Ti, at the most 0.55% Al, at the most 0.3% C, at the most 1% Si, at the most 0.015% P, at the most 0.015% S, at the most 3% Mn, at the most 25% Fe, and a balance of Ni.

19. An exhaust valve according to claim 18, wherein the components Al, Ti and Ni are limited to at the most 0.5% Al, 0.7–3% Ti and 52–57% Ni, the content of Nb+Ta/2 optionally being at least 3%.

20. An exhaust valve according to claim 17, wherein the yield strength of the alloy has been further increased by cold-working of the alloy after the HIP process.

21. An exhaust valve according to claim 17, wherein the seat alloy comprises 10–25% Cr, at the most 25% Co, at the most 10% Mo+W, at the most 11% Nb, at the most 20% Ta, at the most 3% Ti, at the most 0.55% Al, at the most 0.3% C, at the most 1% Si, at the most 0.015% P, at the most 0.015% S, at the most 3% Mn, at the most 25% Fe, and a balance of Ni.

22. An exhaust valve according to claim 21, wherein the components Al, Ti and Ni are limited to at the most 0.5% Al, 0.7–3% Ti and 52–57% Ni, the content of Nb+Ta/2 optionally being at least 3%.

23. An exhaust valve according to claim 21, wherein the thermo-mechanical deformation includes cold-working of the seat alloy.

24. An exhaust valve according to claim 21, wherein the yield strength of the alloy has been increased through a precipitation-hardening heat treatment.

25. An exhaust valve according to claim 17, wherein the seat alloy has a yield strength of at least 1100 MPa.

26. An exhaust valve according to claim 17, wherein the seat alloy has a yield strength of at least 1200 MPa.

27. An exhaust valve according to claim 17, wherein the seat alloy has a yield strength of at least 1300 MPa.

28. An exhaust valve according to claim 17, wherein the seat alloy has a yield strength of at least 1400 MPa.

29. An exhaust valve according to claim 17, wherein the seat areas on the stationary member and the valve disc, respectively, have mainly the same yield strength at operating temperatures of the seat areas.

30. An exhaust valve according to claim 17, wherein the seat area on the valve disc has a substantially lower yield strength than the seat area on the stationary member at operating temperatures of the seat areas.

31. An exhaust valve for an internal combustion engine, the exhaust valve having a movable spindle with a valve disc of a base alloy, said valve disk having an upper surface with an annular seat area of a seat alloy different from said base alloy, said seat alloy having a yield strength ($R_{p0.2}$) of at least 1000 MPa at a temperature of approximately 20° C., and said seat alloy being nickel-based and including 10–25% Cr, and at least one component selected from among Co, Mo, W, Nb, Ta, Ti, Al, C, Si, P, S, Mn and Fe in amounts of at the most 25% Co, at the most 10% Mo+W, at the most 11% Nb, at the most 20% Ta, at the most 3% Ti, at the most 0.55% Al, at the most 0.3% C, at the most 1% Si, at the most 0.015% P, at the most 0.015% S, at the most 3% Mn, and at the most 25% Fe.

32. An exhaust valve according to claim 31, wherein the components Al, Ti and Ni are limited to at the most 0.5% Al, 0.7–3% Ti and 52–57% Ni, and the content of Nb+Ta/2 optionally being at least 3%.

33. An exhaust valve according to claim 31, wherein at least the seat area has been manufactured by means of either casting or powder metallurgical application followed by thermo-mechanical deformation at a temperature lower than or around the recrystallisation temperature of the alloy and with a degree of deformation of the seat area increasing the yield strength of said seat alloy to above said 1000 MPa.

* * * * *